US006653263B1

(12) United States Patent
Küpper et al.

(10) Patent No.: US 6,653,263 B1
(45) Date of Patent: Nov. 25, 2003

(54) FLUORINE-CONTAINING LUBRICANTS

(75) Inventors: Stefan Küpper, Langenfeld (DE); Michael Schneider, Jüchen (DE); Walter Grosse Böwing, Dormagen (DE); Alfred Laufenberg, Dormagen (DE); Harald Kluschanzoff, Mettmann (DE)

(73) Assignee: Ecolab Inc., St. Paul, MN (US)

( * ) Notice: Subject to any disclaimer, the term of this patent is extended or adjusted under 35 U.S.C. 154(b) by 86 days.

(21) Appl. No.: 09/655,544

(22) Filed: Sep. 6, 2000

(30) Foreign Application Priority Data

Sep. 7, 1999 (DE) ..... 199 42 534

(51) Int. Cl.[7] ..... C10M 173/00

(52) U.S. Cl. ..... 508/582; 508/579; 508/584; 508/590; 508/463; 508/551; 508/552; 508/269

(58) Field of Search ..... 508/582, 590, 508/584, 463, 551, 552, 579, 269

(56) References Cited

U.S. PATENT DOCUMENTS

| | | | | |
|---|---|---|---|---|
| 3,011,975 | A | | 12/1961 | Nitzsche et al. |
| 3,213,024 | A | | 10/1965 | Blake et al. |
| 3,514,314 | A | | 5/1970 | Nemeth et al. |
| 3,664,956 | A | | 5/1972 | Messina et al. |
| 3,758,618 | A | * | 9/1973 | Deem ..... 585/523 |
| 3,853,607 | A | | 12/1974 | Iyengar et al. |
| 3,860,521 | A | | 1/1975 | Aepli et al. |
| 3,981,812 | A | | 9/1976 | Zletz |
| 4,069,933 | A | | 1/1978 | Newing |
| 4,105,716 | A | | 8/1978 | Sakai et al. |
| 4,149,624 | A | | 4/1979 | Douty et al. |
| 4,162,347 | A | | 7/1979 | Montgomery |
| 4,248,724 | A | | 2/1981 | MacIntosh |
| 4,264,650 | A | | 4/1981 | Schulze et al. |
| 4,289,671 | A | | 9/1981 | Hernandez |
| 4,324,671 | A | | 4/1982 | Christian et al. |
| 4,436,200 | A | | 3/1984 | Hodlewsky et al. |
| 4,478,889 | A | | 10/1984 | Maruhashi et al. |
| 4,486,378 | A | | 12/1984 | Hirata et al. |
| 4,486,378 | A | | 12/1984 | Hirata et al. |
| 4,515,836 | A | | 5/1985 | Cobbs, Jr. et al. |
| 4,525,377 | A | | 6/1985 | Nickel et al. |
| 4,534,995 | A | | 8/1985 | Pocock et al. |
| 4,538,542 | A | | 9/1985 | Kennon et al. |
| 4,543,909 | A | | 10/1985 | Sharpless |
| 4,555,543 | A | | 11/1985 | Effenberger et al. |
| 4,569,869 | A | | 2/1986 | Kushida et al. |
| 4,573,429 | A | | 3/1986 | Cobbs, Jr. et al. |
| 4,632,053 | A | | 12/1986 | Villanueva et al. |
| 4,652,386 | A | | 3/1987 | Alberts et al. |
| 4,690,299 | A | | 9/1987 | Cannon |
| 4,699,809 | A | | 10/1987 | Maruhashi et al. |
| 4,713,266 | A | | 12/1987 | Hasegawa et al. |
| 4,714,580 | A | | 12/1987 | Maruhashi et al. |
| 4,719,022 | A | | 1/1988 | Hyde |
| 4,803,005 | A | * | 2/1989 | Juhlke et al. ..... 508/582 |
| 4,828,727 | A | * | 5/1989 | McAninch ..... 585/10 |
| 4,839,067 | A | | 6/1989 | Jansen |
| 4,851,287 | A | | 7/1989 | Hartsing, Jr. |
| 4,855,162 | A | | 8/1989 | Wrasidlo et al. |
| 4,875,647 | A | | 10/1989 | Takagi et al. |
| 4,919,984 | A | | 4/1990 | Maruhashi et al. |
| 4,925,583 | A | * | 5/1990 | Juhlke et al. ..... 508/582 |
| 4,929,375 | A | | 5/1990 | Rossio et al. |
| 4,980,211 | A | | 12/1990 | Kushida et al. |
| 5,001,935 | A | | 3/1991 | Tekkanat et al. |
| 5,009,801 | A | | 4/1991 | Wider et al. |
| 5,032,302 | A | * | 7/1991 | Juhlke et al. ..... 5085/582 |
| 5,061,389 | A | * | 10/1991 | Reichgott ..... 508/582 |
| 5,073,280 | A | | 12/1991 | Rossio et al. |
| 5,115,047 | A | | 5/1992 | Hashimoto et al. |
| 5,145,721 | A | | 9/1992 | Kojima et al. |

(List continued on next page.)

FOREIGN PATENT DOCUMENTS

| | | |
|---|---|---|
| CA | 1157456 A | 11/1983 |
| DE | 2 313 330 | 10/1973 |
| DE | 36 31 953 | 3/1988 |
| DE | 39 05 548 | 9/1990 |
| DE | 42 06 506 | 9/1993 |
| DE | 44 23 203 A1 | 1/1995 |
| EP | 0 359 330 | 3/1990 |
| EP | 0 372 628 | 5/1993 |
| EP | 0 629 234 | 11/1995 |
| EP | 0 844 299 | 5/1998 |
| GB | 1564128 | 4/1980 |
| JP | 57003892 | 1/1982 |
| JP | 10053679 A | 8/1986 |
| JP | 06136377 A2 * | 5/1994 |
| JP | 6-136377 | 5/1994 |
| JP | 10059523 | 3/1998 |
| NL | 9300742 | 5/1993 |
| WO | WO 94/03562 | 2/1994 |
| WO | 96/08601 | 3/1996 |
| WO | WO 01/07544 A1 | 2/2001 |

OTHER PUBLICATIONS

Patent Abstracts of Japan, JP 09–095692 A. "Water–Soluble Lubricant Composition." Apr. 8, 1997.

Patent Abstracts of Japan, JP 06–17278 A. "Lubricant for Conveyor." Jun. 21, 1994.

Patent Abstract of Japan, JP 06–136377 A. "Bacterial Lubricant." May 17, 1994.

Huber et al. "Silicone Oils: Synthesis, Production, Characteristics, and Applications". Presented at the 4$^{th}$ Annual Internal Colloquium "Synthetic and Operating Fluids", Technical Academy of Esslingen, Jan. 10–12, 1084, Ostifildern, and English translation.

"A fracture mechanics approach to environmental stress cracking in poly(ethyleneterephthalate)," *Polymer*, vol. 39, No. 3, pp. 75–80 (1998).

(List continued on next page.)

*Primary Examiner*—Jacqueline V. Howard
(74) *Attorney, Agent, or Firm*—Merchant & Gould P.C.

(57) ABSTRACT

The invention relates to the use of formulations containing selected fluorinated components for reducing friction between conveyor systems and the containers transported thereon.

45 Claims, No Drawings

U.S. PATENT DOCUMENTS

| | | | | | |
|---|---|---|---|---|---|
| 5,160,646 | A | | 11/1992 | Scheld | |
| 5,174,914 | A | | 12/1992 | Gutzmann | |
| 5,182,035 | A | | 1/1993 | Schmidt et al. | |
| 5,191,779 | A | | 3/1993 | Imazu et al. | |
| 5,211,861 | A | * | 5/1993 | Lafratta et al. | 508/582 |
| 5,238,718 | A | | 8/1993 | Yano et al. | |
| 5,317,061 | A | | 5/1994 | Chu et al. | |
| 5,334,322 | A | | 8/1994 | Williams, Jr. | |
| RE34,742 | E | | 9/1994 | Maier et al. | |
| 5,352,376 | A | | 10/1994 | Gutzmann | |
| 5,371,112 | A | | 12/1994 | Sayre et al. | |
| 5,391,308 | A | | 2/1995 | Despo | |
| 5,486,316 | A | | 1/1996 | Bershas et al. | |
| 5,509,965 | A | | 4/1996 | Harry et al. | |
| 5,539,059 | A | * | 7/1996 | Bierschenk et al. | 525/331.6 |
| 5,549,836 | A | | 8/1996 | Moses | |
| 5,559,087 | A | | 9/1996 | Halsrud et al. | |
| 5,565,127 | A | | 10/1996 | Laufenberg et al. | |
| 5,573,819 | A | | 11/1996 | Nugent, Jr. et al. | |
| 5,652,034 | A | | 7/1997 | Seiner | |
| 5,658,619 | A | | 8/1997 | Kirschner et al. | |
| 5,663,131 | A | | 9/1997 | Winicov et al. | |
| 5,672,401 | A | | 9/1997 | Anglin et al. | |
| 5,681,628 | A | | 10/1997 | Niederst et al. | |
| 5,698,269 | A | | 12/1997 | Carlblom et al. | |
| 5,721,023 | A | | 2/1998 | Ostapchenko | |
| 5,728,770 | A | | 3/1998 | Yamamoto et al. | |
| 5,783,303 | A | | 7/1998 | Tsuei | |
| 5,789,459 | A | | 8/1998 | Inagaki et al. | |
| 5,863,874 | A | | 1/1999 | Person Hei et al. | |
| 5,869,436 | A | | 2/1999 | Lindman | |
| 5,876,812 | A | | 3/1999 | Frisk et al. | |
| 5,925,601 | A | | 7/1999 | McSherry et al. | |
| 5,935,914 | A | | 8/1999 | Theyssen et al. | |
| 6,090,761 | A | * | 7/2000 | Butler et al. | 508/486 |
| 6,207,622 | B1 | * | 3/2001 | Li et al. | 508/208 |
| 6,214,777 | B1 | * | 4/2001 | Li et al. | 508/388 |

OTHER PUBLICATIONS

"Environmental Stress Cracking Resistance of Blow Molded Poly(Ethylene Terephrhalate) Containers," *Polymer Engineering and Science*, vol. 32, No. 6, pp. 393–399 (Mar. 1992).

"Environmental Stree Cracking in PET Carbonated Soft Drink Containers," Eric J. Moskala, Ph.D., Eastman Chemical Company, presented at Bev Tech 98 (Savannah, GA).

Lubrication and Lubricants, *Encyclopedia of Chemical Technology*, vol. 15, pp. 463–517.

Material Safety Data Sheet for Lubostar CP (May 3, 2000).

"The Alternative to Soap and Water for Lubricating Conveyor Lines," *Food & Drink Business*, pp. 35–36 (Jan. 1998).

"Fin Food Lube AL. High Penetration Teflon® Lubricating Agent Especially for Automatic Lubrication Systems for the Food Processing Industry", *INTERFLON*, 20 pgs. (Date unknown).

Gangal, S., "Polytetrafluoroethylene", *Encyclopedia of Chemical Technology*, 4th Ed., vol. 11, pp. 621–644 (Date unknown).

Kondoh, M., "An Aersol Lubricant ", *Japanese Patent Application No. 57–3892,* 9 pgs. (Filed Jun. 10, 1980; Published Jan. 9, 1982).

"Krytox® Dry Film Lubricants", *DUPONT*, 6 pgs. (Nov. 1997).

"Lube Application to Conveyor Surface/Containers", *Ecolab*, 7 pgs. (Jun. 13, 2000).

"Maintenance Products with Teflon®", http://www.interflon.nl/engels.htm, *INTERFLON*, 10 pgs. (Printed Jun. 18, 1999).

Moskala, E., "Environmental Stress Cracking in PET Beverage Containers", *BEV–PAK AMERICAS '96*, 14 pgs. (Apr. 15–16, 1996).

Moskala, E., "Environmetal Stress Cracking in PET Carbonated Soft Drink Containers", *Bev Tech 98*, 22 pgs. (Mar. 30–Apr. 1, 1998).

"Other Super Lube Products . . . What is Super Lube®?" http://www.super–lube.com, *Synco Chemical Corporation,* 5 pgs. (Printed May 5, 1999).

Tekkanat, B. et al., "Environmental Stress Cracking Resistance of Blow Molded Poly(Ethylene Terephthalate) Containers", *Polymer Engineering and Science*, vol. 32, No. 6, pp. 393–397 (Mar. 1992).

* cited by examiner

FLUORINE-CONTAINING LUBRICANTS

This invention relates to the use of formulations containing at least one fluorinated component for reducing the friction between conveyors and the articles transported thereon.

In the food industry and especially in beverage factories, the containers to be filled in the bottling plants are conveyed by conveyors differing in design and constituent materials, for example by platform conveyors or chain-like arrangements which are generally referred to hereinafter as chain conveyors. The conveyors establish the connection between the various optional treatment stages of the bottling process such as, for example, the unpacker, bottle washer, filler, closer, labeller, packer, etc. The containers may assume various forms, more particularly glass and plastic bottles, cans, glasses, casks, beverage containers (kegs), paper and paperboard containers. To guarantee uninterrupted operation, the conveyor chains have to be suitably lubricated to avoid excessive friction with the containers. Dilute aqueous solutions containing suitable friction-reducing ingredients are normally used for lubrication. The chain conveyors are contacted with the aqueous solutions by dipping or spraying, for example, the corresponding lubrication systems being known as dip lubrication or automatic belt lubrication or central chain lubrication systems.

The chain lubricants hitherto used as lubricants are mostly based on fatty acids in the form of their water-soluble alkali metal or alkanolamine salts or on fatty amines, preferably in the form of their organic or inorganic salts.

Whereas both classes of substances can be used without difficulty in dip lubrication, they are attended by a number of disadvantages in the central chain lubrication systems typically in use today. Thus, DE-A-23 13 330 describes soap-based lubricants containing aqueous mixtures of $C_{16-18}$ fatty acid salts and surface-active substances. Soap-based lubricants such as these have the following disadvantages:

1. They react with the hardness ions in water, i.e. the alkaline earth metal ions, and other ingredients of water to form poorly soluble metal soaps, so-called primary alkaline earth metal soaps.
2. A reaction takes place between the soap-based lubricants and carbon dioxide dissolved in water or in the product to be bottled.
3. The in-use solution thus prepared is always germ-promoting.
4. Where hard water is used, ion exchangers have to be employed to soften the water which means an additional source of germs (and is therefore hardly encountered in practice) or, alternatively, products of high complexing agent content have to be used which is ecologically unsafe.
5. Increased foaming occurs which can cause problems in particular at the bottle inspector (automatic bottle control) and results in greater wetting of the transport containers.
6. Most of these products contain solvents.
7. The cleaning effect of the products is poor so that separate cleaning is necessary.
8. Corresponding soap-based lubricant preparations show pH-dependent performance.
9. In addition, soap-based lubricant preparations are dependent on the water temperature.
10. Soap-based lubricants show poor stability in storage, particularly at low temperatures.
11. The EDTA (ethylenediamine tetraacetate) present in many products is known to have poor biodegradability.
12. Soap-based lubricant preparations are not suitable for all plastic transport containers because, in many cases, they give rise to stress cracking in the transport container.

Besides soap-based lubricants, lubricants based on fatty amines are mainly used. Thus, DE-A-36 31 953 describes a process for lubricating chain-type bottle conveyors in bottling factories, more particularly in breweries, and for cleaning the conveyors with a liquid cleaning composition, characterized in that the chain-type bottle conveyors are lubricated with belt lubricants based on neutralized primary fatty amines which preferably contain 12 to 18 carbon atoms and which have an unsaturated component of more than 10%.

EP-A-0 372 628 discloses fatty amine derivatives corresponding to the following formulae:

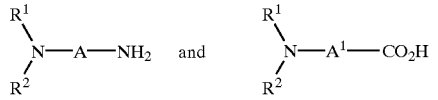

in which $R^1$ is a saturated or unsaturated, branched or linear alkyl group containing 8 to 22 carbon atoms, $R^2$ is hydrogen, an alkyl or hydroxyalkyl group containing 1 to 4 carbon atoms or —A—$NH_2$, A is a linear or branched alkylene group containing 1 to 8 carbon atoms and $A^1$ is a linear or branched alkylene group containing 2 to 4 carbon atoms, as lubricants.

In addition, lubricants based on N-alkylated fatty amine derivatives which contain at least one secondary and/or tertiary amine are known from DE-A-39 05 548.

DE-A42 06 506 relates to soapless lubricants based on amphoteric compounds, primary, secondary and/or tertiary amines and/or salts of such amines corresponding to general formulae (I), (IIa), (IIb), (IIIa), (IIIb), (IIIc), (IVa) and (IVb):

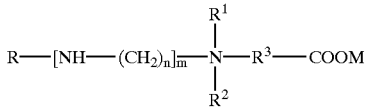

(I)

$R^4$—NH—$R^5$ (IIa)

$R^4$—$N^+H_2$—$R^5X^-$ (IIb)

$R^4$—NH—$(CH_2)_3NH_2$ (IIIa)

$R^4$—NH—$(CH_2)_3N^+H_3X^-$ (IIIb)

$R^4$—$N^+H_2$—(CH2)3-$N^+H_32X^-$ (IIIc)

$R^4$—$NR^7R^8$ (IVa) and/or $R^4$—$N^+HR^7R^8X^-$ (IVb)

in which

R is a saturated or mono- or polyunsaturated, linear or branched alkyl group containing 6 to 22 carbon atoms which may optionally be substituted by —OH, —$NH_2$, —NH—, —CO—, —$(CH_2CH_2O)_l$— or —$(CH_2CH_2CH_2O)_l$—, $R^1$ is hydrogen, an alkyl group containing 1 to 4 carbon atoms, a hydroxyalkyl group containing 1 to 4 carbon atoms or a group —$R^3$COOM, $R^2$ is hydrogen, an alkyl group containing 1 to 4 carbon atoms or a hydroxyalkyl group containing 1 to 4 carbon atoms, but only where M represents a negative charge, $R^3$ is a saturated or mono- or polyunsaturated, linear or branched alkyl group containing 1 to 12 carbon atoms which may optionally be substituted by —OH, —$NH_2$, —NH—, —CO—, —$(CH_2CH_2O)_l$— or —$(CH_2CH_2CH_2O)_l$—, $R^4$ is a substituted or unsubstituted, linear or branched, saturated or mono- or polyunsaturated alkyl group containing 6 to 22 carbon atoms which may contain at least one amine, imine, hydroxy, halogen and/or carboxy group as substituent, a substituted or unsubstituted phenyl group which may contain at least one amine, imine, hydroxy,3 halogen, carboxy and/or a linear or branched, saturated or mono- or polyunsaturated alkyl group containing 6 to 22 carbon atoms as substituent, $R^5$ is hydrogen or—independently of $R^4$—has the same meaning as $R^4$, $X^-$ is an anion from the group consisting of amidosulfonate, nitrate, halide, sulfate, hydrogen carbonate, carbonate, phosphate or $R^6$—COO— where $R^6$ is hydrogen, a substituted or unsubstituted, linear or branched alkyl group containing 1 to 20 carbon atoms or alkenyl group containing 2 to 20 carbon atoms, which may contain at least one hydroxy, amine or imine group as substituent, or a substituted or unsubstituted phenyl group which may contain an alkyl group with 1 to 20 carbon atoms as substituent, and $R^7$ and $R^8$ independently of one another represent a substituted or unsubstituted, linear or branched alkyl group containing 1 to 20 carbon atoms or alkenyl group containing 2 to 20 carbon atoms which may contain at least one hydroxy, amine or imine group as substituent, or a substituted or unsubstituted phenyl group which may contain an alkyl group with 1 to 20 carbon atoms as substituent, M is hydrogen, alkali metal, ammonium, an alkyl group containing 1 to 4 carbon atoms, a benzyl group or a negative charge, n is an integer of 1 to 12, m is an integer of 0 to 5 and l is a number of 0 to 5, containing alkyl dimethylamine oxides and/or alkyl oligoglycosides as nonionic surfactants.

EP-B-629 234 discloses a lubricant combination consisting of a) one or more compounds corresponding to the following formula:

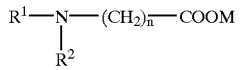

in which $R^1$ is a saturated or mono- or polyunsaturated, linear or branched alkyl group containing 6 to 22 carbon atoms which may optionally be substituted by —OH, —$NH_2$—, —NH—, —CO—, halogen or a carboxyl group, $R^2$ is a carboxyl group containing 2 to 7 carbon atoms, M is hydrogen, alkali metal, ammonium, an alkyl group containing 1 to 4 carbon atoms or a benzyl group and n is an integer of 1 to 6, b) at least one organic carboxylic acid selected from monobasic or polybasic, saturated or mono- or polyunsaturated carboxylic acids containing 2 to 22 carbon atoms, c) optionally water and additives and/or auxiliaries.

WO 94/03562 describes a lubricant concentrate based on fatty amines and optionally typical diluents or auxiliaries and additives, characterized in that it contains at least one polyamine derivative of a fatty amine and/or a salt of such an amine, the percentage content of the polyamine derivatives of fatty amines in the formulation as a whole being from 1 to 100% by weight.

In one preferred embodiment of WO 94/03562, this lubricant concentrate contains at least one polyamine derivative of a fatty amine corresponding to the following general formula:

$$R—A—(CH_2)_k—NH—[(CH_2)_l—NH]_y—(CH_2)_m—NH_2.(H^+X^-)_n$$

in which

R is a substituted or unsubstituted, linear or branched, saturated or mono- or polyunsaturated alkyl group containing 6 to 22 carbon atoms, the substituents being selected from amino, imino, hydroxy, halogen and carboxy, or a substituted or unsubstituted phenyl group, the substituents being selected from amino, imino, hydroxy, halogen, carboxy and a linear or branched, saturated or mono- or polyunsaturated alkyl group containing 6 to 22 carbon atoms, A represents either —NH— or —O—, $X^-$ is an anion of an inorganic or organic acid, k, l and m independently of one another are integers of 1 to 6, y is 0, 1, 2 or 3 where A=—NH— or 1, 2, 3 or 4 where A=—O— and n is an integer of 0 to 6.

Lubricants based on polytetrafluoroethylene are used in some bottling plants. They are present in the form of dispersions and are not applied to the chains in the usual way through nozzles, but instead by brushes. These lubricants have the advantage that they significantly reduce the friction between the conveyor belts and the containers transported thereon. In addition, the polytetrafluoroethylene adheres very strongly to the chains. A disadvantage encountered in practice was that the overall hygienic state in regard to germ population and soiling of the chain conveyors was adversely affected to such an extent that the performance profile of the lubricant gradually deteriorated as a result of the increase in soiling.

Another disadvantage encountered was that the dispersions of polytetrafluoroethylene were not stable in storage and gradually separated. The result of this is that, over a prolonged period, varying amounts of active substance are applied to the chain conveyors.

When an attempt was made to clean the chain conveyors, it was found that the layer of lubricant was very difficult to remove from the chains.

In addition, investigation of the compatibility of polytetrafluoroethylene dispersions with plastics showed that they produce stress cracks in PET bottles.

The problem addressed by the present invention was to provide lubricants based on organic fluorine compounds which, on the one hand, would be stable in storage and, on the other hand, compatible with plastic containers and which at the same time would improve lubricating performance by comparison with the amines typically used as lubricants.

The present invention relates to the use of formulations containing at least one fluorinated component selected from the groups of a) perfluorinated or partly fluorinated monomeric organic compounds, b) pure and mixed dimers and oligomers based on at least one perfluorinated or partly fluorinated organic monomer, c) pure and mixed polymers based on at least one perfluorinated or partly fluorinated organic monomer, the polymer containing at least one monomer unit which contains either less than 70% by weight of fluorine, based on the weight of the total monomer unit, or more than 2 carbon atoms, for reducing the friction between conveyor installations and the containers transported thereon.

According to the invention, the definition of the boundary between oligomers and polymers is based on the generally known characterization of polymers which are made up of so many identical or similar low molecular weight units (monomers) that the physical properties of these substances, particularly their viscoelasticity, do not change significantly when the number of units is increased or reduced by one unit. This is generally the case when the average molecular weight of the "polymers" is 10,000 g/mole or more.

The term oligomers is used for the low molecular weight dimers, trimers and other lower members of the polymer-homolog series.

In one preferred embodiment, group a) comprises at least perfluorinated and partly fluorinated surfactants, alkanes, ethers and amines, the formulations used in accordance with the invention in one particularly preferred embodiment containing ammonium perfluoroalkyl sulfonates, lithium perfluoroalkyl sulfonates, potassium perfluoroalkyl sulfonates, amine perfluoroalkyl sulfonates, sodium perfluoroalkyl sulfonates, potassium fluoroalkyl carboxylates, quaternary fluorinated alkyl ammonium iodides, ammonium perfluoroalkyl carboxylates, fluorinated alkyl polyoxyethylene ethanols, fluorinated alkyl alkoxylates, fluorinated alkyl esters in concentrations of 0.001 to 10%. The fluorinated components of group c) are preferably perfluorinated and/or partly fluorinated alkoxy polymers which, in one particularly preferred embodiment, are obtainable from the copolymerization of tetrafluoroethylene and perfluoroalkoxyvinyl ethers.

In another preferred embodiment, the formulations to be used in accordance with the invention contain at least perfluorinated and/or partly fluorinated polyethers from group c).

In another preferred embodiment, the formulations to be used in accordance with the invention are present in the form of solutions, gels, emulsions, pastes, dispersions.

In one preferred embodiment, the formulations to be used in accordance with the invention additionally contain at least one antimicrobial component selected from the groups of alcohols, aldehydes, antimicrobial acids, carboxylic acid esters, acid amides, phenols, phenol derivatives, diphenyls, diphenyl alkanes, urea derivatives, oxygen and nitrogen acetals and formals, benzamidines, isothiazolines, phthalimide derivatives, pyridine derivatives, antimicrobial surface-active compounds, guanidines, antimicrobial amphoteric compounds, quinolines, 1,2-dibromo-2,4-dicyanobutane, iodo-2-propynyl butyl carbamate, iodine, iodophors, peroxides, the formulations to be used in accordance with the invention in one particularly preferred embodiment containing one or more compounds selected from ethanol, n-propanol, i-propanol, butane-1,3-diol, phenoxyethanol, 1,2-propylene glycol, glycerol, undecylenic acid, citric acid, 2-benzyl4-chlorophenol, 2,2'-methylene-bis-(6-bromo-4-chlorophenol), 2,4,4'-trichloro-2'-hydroxydiphenyl ether, N-(4-chlorophenyl)-N-(3,4-dichlorophenyl)-urea, N,N'-(1,10-decanediyldi-1-pyridinyl-4-ylidene)-bis-(1-octaneamine)-dihydrochloride, N,N'-bis-(4-chlorophenyl)-3,12-diimino-2,4,11,13-tetraazatetradecane diimidoamide, quaternary ammonium compounds or alkyl amines, guanidines, amphoteric surfactants as antimicrobial components.

Whereas stable formulations of polytetrafluoroethylene dispersions and antimicrobial components are very difficult or impossible to obtain, the formulations containing antimicrobial components to be used in accordance with the invention generally give stable formulations.

In another preferred embodiment, the formulations to be used in accordance with the invention additionally contain at least one component selected from the group of polyhydroxy compounds, more particularly from the groups of polyalcohols and carbohydrates, and—in one most particularly preferred embodiment—a component selected from polyhydric alcohols, preferably alkanediols, alkanetriols, more particularly glycerol, and the polyethers derived therefrom and glucose, arabinose, ribulose, fructose and the oligo- and/or polysaccharides derived therefrom and their esters and ethers.

In another preferred embodiment, the formulations to be used in accordance with the invention contain other components selected from the groups of surfactants and solubilizing agents, at least one alkyl polyglycoside being present as surfactant in a particularly preferred embodiment. Other preferred constituents are fatty alkylamines and/or alkoxylates thereof, more particularly cocofatty amine ethoxylates, and/or imidazoline compounds and/or amphoteric surfactants and/or nonionic surfactants and/or ether carboxylic acids and/or ether amine compounds. In another preferred embodiment, paraffin compounds are added to the formulations to be used in accordance with the invention. The water content of the formulations to be used in accordance with the invention is preferably below 20% by weight and more preferably below 10% by weight, based on the formulation as a whole, the formulations in particularly special embodiments containing no water which, in the context of the invention, means that water is not intentionally added to the formulation. In practice, the formulations to be used in accordance with the invention are applied to the chain conveyors. In the most favorable case, the transport of the containers on the conveyors is not accompanied by foaming. By comparison with conventional lubricants which are diluted with water by a factor of more than 100 in automatic conveyor installations, the formulations to be used in accordance with the invention reduce frictional resistance between the conveyor and the containers transported thereon by more than 20% by for the same quantities by weight of active lubricating components applied to the conveyor installation over a certain period of time. This is demonstrated by the following Examples.

EXAMPLE 1

A comparison formulation 1 which contains 5% by weight of coconut propylenediamine and which is adjusted to pH 7 with acetic acid is applied to the chain conveyors in a concentration in water of 0.2% through a nozzle block comprising five nozzles each capable of spraying 5 liters per hour. 50 ml of the comparison formulation or ca. 2.5 g of the coconut propylenediamine are thus applied to the conveyor chains over a period of 1 hour. This test is carried out for 10 hours. According to the invention, the coefficient of friction between the bottles and the stainless steel conveyor chains is defined as the ratio of the tractive weight applied, for example, to a spring balance when an attempt is made to hold a bottle still while the conveyor is moving to the weight of that bottle.

Where the Comparison Example described above is used, the coefficient of friction $\mu$ is 0.10. When spraying is stopped, the friction coefficient increases rapidly and the bottles fall over after only a few minutes.

In the Comparison Example, a total of 25 ml of lubricating coconut propylenediamine raw materials is applied to the conveyor chains over the total test duration of 10 hours. In a second test, 25 ml of a formulation to be used in accordance with the invention consisting of 5% by weight of perfluoropolyether and 95% by weight of glycerol is distributed over the chain conveyors with a cloth. The coefficient of friction between the bottles and the chain conveyor is then measured over a period of 10 hours under exactly the same conditions as in Comparison Example 1. The coefficient of friction p is between 0.04 and 0.05 over the entire test duration of 10 hours. This Example shows that the friction coefficient between the bottles and the conveyor system can be reduced by more than 20% and, in the present case, even by more than 40%.

Another preferred embodiment of the present invention is the use of the formulations to be used in accordance with the invention for the conveying of plastic containers, the plastic containers in one particularly preferred embodiment containing at least one polymer selected from the groups of polyethylene terephthalates (PET), polyethylene naphthenates (PEN), polycarbonates (PC), PVC. In one most particularly preferred embodiment, the containers are PET bottles. In a laboratory test, the stress cracking of a Comparison Example based on 5% polytetrafluoroethylene dispersion is measured by comparison with a 5% perfluoropolyether solution in 95% glycerol.

EXAMPLE 2

According to the test specification, PET bottles are filled with water and conditioned with carbon dioxide in such a way that a pressure of about 7 bar is present inside the bottles. The base cups of the bottles are then dipped in the formulation of the Comparison Example and the Example to be used in accordance with the invention and are placed in a Petri dish for 24 hours. Thereafter the bottles are opened, emptied and their base cups are rinsed with water. Visual inspection of the base cups of the bottles shows that, in the test with the Comparison Example, many stress cracks of average depth (classification C) are present whereas the test with the Example to be used in accordance with the invention produces only a few stress cracks of minimal depth (classification A). The stress cracks are classified in accordance with the reference images appearing in Chapter IV-22 of the book entitled "CODE OF PRACTICE—Guidelines for an Industrial Code of Practice for Refillable PET Bottles", Edition 1, 1993–1994.

Example 2 shows that the formulations to be used in accordance with the invention have advantages over polytetrafluoroethylene dispersions in the conveying of plastic bottles.

In another preferred embodiment, the formulations to be used in accordance with the invention are used for conveying paperboard packs.

In another preferred use, the conveying surfaces of the conveyor belts are made of plastic—in one particularly preferred embodiment of polyacetal and polyethylene.

In another preferred embodiment, the conveying surfaces of the conveyor belt are made of metal—in one particularly preferred embodiment stainless steel.

In another preferred embodiment, additional antimicrobial agents, more particularly organic peracids, chlorine dioxide or ozone, are additionally incorporated in the formulations to be used in accordance with the invention through separate feed systems either before or after application of the formulations.

In another preferred embodiment, the formulations to be used in accordance with the invention are applied to the conveyor belts without dilution with water using an aid selected from paint brushes, sponges, rollers, cloths, brushes, wipers, rubber, spray nozzles. In another preferred embodiment, the formulations to be used in accordance with the invention are diluted with water in automatic conveyor systems and the resulting solution is applied to the conveyors through metering systems, the dilution factor being between 10,000 and 100. In another preferred embodiment, the formulations to be used in accordance with the invention are selected and applied in such a way that there is no further proliferation of microorganisms on surfaces in contact with the formulations or solution. In one most particularly preferred embodiment, the number of microorganisms is reduced.

The formulations to be used in accordance with the invention are preferably used for the conveying of containers in the food industry. In particularly preferred cases, soil occurring is repelled by the conveyor belts conditioned with the formulation, the consumption of water is reduced by at least 80% and no lubricant drips onto the floor providing the lubricants are properly applied to the chain conveyors.

What is claimed is:

1. A method of lubricating the interface between a container and a moving conveyor surface, the method comprising forming an effective amount of a liquid lubricant composition between a container and a contact surface of the moving conveyor, the lubricant comprising an aqueous solution comprising an antimicrobial compound and a fluorinated monomeric organic compound.

2. The method of claim 1 wherein the fluorinated monomeric organic compound comprises a perfluorinated monomeric organic compound.

3. The method of claim 1 wherein the fluorinated monomeric organic compound comprises a fluorinated surfactant, a fluorinated alkane; a fluorinated ether, a fluorinated amine or mixtures thereof.

4. The method of claim 1 wherein the lubricant is present in the form of a gel, emulsion, paste or dispersion of a liquid lubricant in an aqueous phase.

5. The method of claim 1 wherein the antimicrobial component comprises alcohols, aldehydes, antimicrobial acids, carboxylic acid esters, acid amides, phenols, phenol derivatives, diphenyls, diphenyl alkanes, urea derivatives, oxygen and nitrogen acetals and formals, benzamidines, isothiazolines, phthalimide derivatives, pyridine derivatives, antimicrobial surface-active compounds, guanidines, antimicrobial amphoteric compounds, quinolines, 1,2-dibromo-2,4-dicyanobutane, iodo-2-propynyl butyl carbamate, iodine, iodophors, peroxides or mixtures thereof.

6. The method claimed in claim 1, wherein the antimicrobial compound comprises ethanol, n-propanol, i-propanol, butane-1,3-diol, phenoxyethanol, 1,2-propylene glycol, glycerol, undecylenic acid, citric acid, 2-benzyl-4-clorophenol, 3,3'-methylene-bis(6-bromo-4-chlorophenol), 2,4,4'-trichlor-2'-hydroxyphenyl ether, N-(4-chlorophenyl)-N-(3,4-dichlorophenyl)-urea, N,N'-(1,10-decanediydi-1-pyridinyl-4-ylidene)7-bis-(1-octaneamine)-dihydrochloride, N,N'-bis-(4-chlorophenyl)3,12-diimino-2,4,11,13-tetraazatetradecane diimidoamide, quaternary ammonium compound, alkyl amine, guanidine, amphoteric surfactant.

7. The method of claim 1 wherein the formulations additionally contain at least one fluorinated component selected from the group of fluorine free polyhydroxy compounds.

8. The method of claim 7 wherein the polyhydroxy compounds are selected from the groups of polyalcohols and carbohydrates.

9. The method of claim 1 wherein the polyhydroxy component comprises a polyhydroxy alcohol, an alkanediol, an alkanetriol, polyethers derived thereof, glucose, arabinose, ribulose, fructose, the oligo- or polysaccharides derived thereof and their esters and ethers.

10. The method of claim 1 wherein the formulations comprise a surfactant and a solubilizing agent.

11. The method of claim 10 wherein the lubricant comprises at least one alkyl polyglycoside.

12. The method of claim 1 wherein the formulations have a water content of less than 20% by weight, based on the formulation as a whole.

13. The method of claim 1 wherein the water content is less than 10% by weight, based on the formulation as a whole.

14. The method of claim 1 wherein substantially no foam is formed from the lubricant during the conveying of the containers on the conveyors.

15. The method of claim 1 wherein, by comparison with conventional lubricants are diluted with water by a factor of more than 100 in automatic conveyor installations, the frictional resistance between the conveyor and the containers transported thereon is reduced by more than 20% for the same quantities by weight of active lubricating components applied to the conveyor.

16. The method of claim 1 for lubricating the interface between a conveyor and a plastic container.

17. The method of claim 16 wherein the plastic container comprises at least one polymer selected from the groups of polyethylene terephthalate (PET), polyethylene naphthenate (PEN), polycarbonate (PC), polyvinyl chloride (PVC).

18. The method of claim 17 wherein the plastic containers are 2 liter beverage bottles.

19. The method of claim 1 for lubricating the interface between a conveyor and containers in paperboard packs.

20. The method of claim 1 wherein the conveying surfaces of the conveyor system are made of plastic.

21. The method of claim 1 wherein the contact surfaces of the conveyor system are made of metal.

22. The method of claim 1 wherein antimicrobial agents are separately added to the conveyor.

23. The method of claim 22 wherein the antimicrobial agent comprises an organic peracid, chlorine dioxide or ozone.

24. The method of claim 1 wherein the formulation is applied to the conveyor belts without preliminary dilution with water using an applicator selected from a brush, a sponge, a roller, a wiper or a spray.

25. The method of claim 1 wherein the formulation is diluted with water in an automatic conveyor system and the resulting solution is applied to the conveyor belt through a metering system.

26. The method of claim 25 wherein the dilution factor comprises one part of lubricant per each 100 to 10,000 parts of diluent by volume.

27. The method of claim 1 wherein there is no further proliferation of microorganisms on surfaces in contact with the lubricant.

28. The method of claim 1 wherein the number of microorganisms on surfaces in contact with the lubricant is reduced.

29. The method of claim 1 for lubricating the interface between a conveyor and a food container.

30. An aqueous lubricant formulation to lubricate the interface between a moving conveyor and a container, the liquid lubricant composition comprising a major proportion of an aqueous medium and about 0.001 to 10 wt % of a fluorinated monomeric organic compound, an antimicrobial compound.

31. The lubricant composition of claim 30 wherein the organic compound comprises a fluorine free monomeric compound.

32. The lubricant of claim 30 wherein the compound comprises a perfluorinated surfactant, an alkane, an ether or an amine.

33. The lubricant of claim 30 wherein the formulation is present in the form of a liquid emulsion.

34. The lubricant of claim 30 wherein the formulation contains at least one antimicrobial component selected from the groups of an alcohol, an aldehyde, an antimicrobial acid, a carboxylic acid ester, an acid amide, a phenol or phenol derivatives, a diphenyl, a diphenyl alkane, an urea derivative, an oxygen or nitrogen acetal or formals, a benzamidine, an isothiazoline, a phthalimide derivative, a pyridine derivative, an antimicrobial surface-active compound, a guanidine, an antimicrobial amphoteric compound, a quinoline, 1,2-dibromo-2,4-dicyanobutane, iodo-2-propynyl butyl carbamate, iodine, an iodophor or a peroxide.

35. The lubricant of claim 30 wherein the formulations contain an antimicrobial compound selected from ethanol, n-propanol, i-propanol, butane-1,3-diol, phenoxyethanol, 1,2-propylene glycol, glycerol, undecylenic acid, citric acid, 2-benzyl4-chlorophenol, 3,3'-methylene-bis(6-bromo-4-chlorophenol), 2,4,4'-trichlor-2'-hydroxydiphenyl ether, N-(4-chlorophenyl)-N-(3,4-dichlorophenyl)-urea, N,N'-(1,10-decanediyldi-1-pyridinyl-4-ylidene)-bis(1-octaneamine)-dihydrochloride, N,N'-bis(4-chlorphenyl)3,12-diimino-2,4,11,13-tetraazatetradecane diimidoamide, quaternary anmnonium compounds or an alkyl amine, a guanidine, or an amphoteric surfactant.

36. The lubricant of claim 30 wherein the formulations additionally contain at least one fluorine free polyhydroxy compound.

37. The lubricant of claim 36 wherein the polyhydroxy compound is selected from the group of polyalcohols and carbohydrates.

38. The lubricant of claim 30 wherein at least one component selected from polyhydric alcohols, alkanediol, alkanetriols, the polyethers derived thereof and glucose, arabinose, ribulose, fructose, the oligo- and/or polysaccharides derived thereof and their esters and ethers.

39. The lubricant of claim 35 wherein the formulation comprises a surfactant or a solubilizing agent.

40. The lubricant of claim 35 wherein the lubricant comprises an alkyl polyglycoside.

41. The lubricant of claim 35 wherein the formulation has a water content of less than 20% by weight, based on the formulation as a whole.

42. The lubricant of claim 35 wherein the water content is below 10% by weight, based on the formulation as a whole.

43. The lubricant of claim 35 wherein, by comparison with conventional lubricants which are diluted with water by a factor of more than 100 in an automatic conveyor installation, the frictional resistance between the conveyor and the containers transported thereon is reduced by more than 20% for the same quantities by weight of active lubricating components.

44. The lubricant of claim 35 wherein the lubricant comprises an organic peracid, chlorine dioxide or ozone.

45. The lubricant of claim 35 wherein each part by weight of lubricant is diluted with about 10,000 to 100 parts of diluent.

* * * * *